US011642668B2

(12) United States Patent
Huang et al.

(10) Patent No.: US 11,642,668 B2
(45) Date of Patent: May 9, 2023

(54) METHOD AND DEVICE OF NONDESTRUCTIVE TRANSFER OF LIQUID DROPS AND METHOD OF MICRO-REACTION OF LIQUID DROPS

(71) Applicant: SOOCHOW UNIVERSITY, Suzhou (CN)

(72) Inventors: Haibo Huang, Suzhou (CN); Hao Shen, Suzhou (CN); Liguo Chen, Suzhou (CN); Mingwei Gu, Suzhou (CN); Youwen Ma, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 0 days.

(21) Appl. No.: 17/764,967

(22) PCT Filed: Dec. 11, 2020

(86) PCT No.: PCT/CN2020/135532

§ 371 (c)(1),
(2) Date: Mar. 29, 2022

(87) PCT Pub. No.: WO2021/203727

PCT Pub. Date: Oct. 14, 2021

(65) Prior Publication Data

US 2022/0355288 A1 Nov. 10, 2022

(30) Foreign Application Priority Data

Apr. 7, 2020 (CN) ..... 202010266981.X

(51) Int. Cl.
*B01L 3/02* (2006.01)

(52) U.S. Cl.
CPC ..... *B01L 3/0268* (2013.01); *B01L 2300/0645* (2013.01); *B01L 2300/161* (2013.01); *B01L 2400/0427* (2013.01)

(58) Field of Classification Search
None
See application file for complete search history.

(56) References Cited

U.S. PATENT DOCUMENTS 8,940,147 B1 * 1/2015 Bartsch ..... B01L 9/527 204/601
10,010,884 B1 * 7/2018 Flory ..... F04B 19/006
(Continued)

FOREIGN PATENT DOCUMENTS

CN 101031362 A 9/2007
CN 102109858 A 6/2011
(Continued)

*Primary Examiner* — Brian R Gordon
(74) *Attorney, Agent, or Firm* — SZDC Law P.C.

(57) ABSTRACT

A device of nondestructive transfer of liquid drops includes a power generation part and a clamping part. The power generation part includes a movable friction material and at least two fixed friction materials. The clamping part includes a supporting mechanism and a left dielectric wetting splint and a right dielectric wetting splint installed on the supporting mechanism. The movable friction material is connected to the left dielectric wetting splint. The at least two fixed friction materials are connected to the right dielectric wetting splint. Also disclosed are a method of nondestructive transfer of liquid drops and a method of micro-reaction of liquid drops.

7 Claims, 6 Drawing Sheets

(56) References Cited

U.S. PATENT DOCUMENTS

| | | | | |
|---|---|---|---|---|
| 10,989,181 | B1 * | 4/2021 | Kuiper | B01L 3/502792 |
| 2012/0261264 | A1 * | 10/2012 | Srinivasan | B01L 3/502792 427/58 |
| 2013/0018611 | A1 * | 1/2013 | Sturmer | B01L 3/502792 702/65 |
| 2014/0322706 | A1 * | 10/2014 | Kayyem | G01N 35/00722 435/287.2 |
| 2018/0318826 | A1 * | 11/2018 | Umapathi | B01L 3/0268 |
| 2019/0361313 | A1 * | 11/2019 | Hodko | B01L 3/502753 |
| 2021/0299660 | A1 * | 9/2021 | Denomme | G01N 33/54386 |

FOREIGN PATENT DOCUMENTS

| | | | |
|---|---|---|---|
| CN | 103752357 | A | 4/2014 |
| CN | 103780122 | A | 5/2014 |
| CN | 104426417 | A | 3/2015 |
| CN | 111804354 | A | 10/2020 |

* cited by examiner

METHOD AND DEVICE OF NONDESTRUCTIVE TRANSFER OF LIQUID DROPS AND METHOD OF MICRO-REACTION OF LIQUID DROPS

This application is the National Stage Application of PCT/CN2020/135532, filed on Dec. 11, 2020, which claims priority to Chinese Patent Application No. 202010266981.X, filed on Apr. 7, 2020, which is incorporated by reference for all purposes as if fully set forth herein.

TECHNICAL FIELD

The present invention relates to the technical field of micro-liquid drop control, and in particular to a triboelectric nanogenerator-based method and device of nondestructive transfer of liquid drops, and a method of micro-reaction of liquid drops.

BACKGROUND

With the rapid development of biochemical technology, the demand for improvement and optimization of its research equipment is also increasing. The invention and development of micro-liquid drop devices have brought new ideas for experimental research in biology and chemistry. The key to the micro-liquid drop device is the drive method of the liquid drop. The existing drive methods include electric drive (EWOD), magnetic drive, surface acoustic wave drive, mechanical drive, and the like. Dielectric wetting (EWOD) method is a commonly used liquid drop control method, but this method of driving liquid drops often requires huge external equipment and special microfluidic chips, which greatly reduces the universality and portability of EWOD microfluidic chips and has become the main reason restricting its development.

The invention of nanomotors has brought new ideas to the improvement of portability. triboelectric nanogenerator (TENG) can convert common mechanical energy in our lives into electrical energy. As a generator of electronic devices or power systems, its characteristics of high voltage and low current are very suitable for the needs of EWOD to drive liquid drops. Here, TENG can provide drive power and control signals for various electromechanical systems, and can be used as a bridge to realize human-machine interaction. Therefore, TENG can also be combined with dielectric wetting technology to realize automatic force manipulation of microfluidics. The fast response capability of TENG can ensure the effective operation of microfluidics, and the good insulation performance of the dielectric wetting system can fully retain the electrostatic field caused by friction. The combination of these two technologies opens up a variety of potential application prospects for TENG-based self-powered technology.

SUMMARY OF THE INVENTION

In view of the shortcomings of the prior art, an object of the present invention is to provide a method and device of nondestructive transfer of liquid drops, and a method of micro-reaction of liquid drops.

In order to achieve the above object, the technical solution according to an embodiment of the present invention is as follows.

A device of nondestructive transfer of liquid drops, including a power generation part and a clamping part, wherein the power generation part includes a movable friction material and at least two fixed friction materials, the clamping part includes a supporting mechanism and a left dielectric wetting splint and a right dielectric wetting splint installed on the supporting mechanism, the movable friction material is connected to the left dielectric wetting splint, and the at least two fixed friction materials are connected to the right dielectric wetting splint.

As a further improvement of the present invention, the supporting mechanism includes a first supporting frame and a second supporting frame connected to the first supporting frame, the left dielectric wetting splint is installed on the first supporting frame, and the right dielectric wetting splint and the at least two fixed friction materials are all installed on the second supporting frame.

As a further improvement of the present invention, a crank connecting rod mechanism is further provided, the crank connecting rod mechanism includes a crank and a slider movably connected to one end of the crank, the other end of the crank is hinged with the first supporting frame, and the slider is connected to the left dielectric wetting splint.

As a further improvement of the present invention, an upper part of the first supporting frame is connected to a bolt, a lower part of the first supporting frame is provided with a spring, the bolt abuts against an upper end of the crank, and the spring abuts against a lower end of the crank.

As a further improvement of the present invention, at least one roller is provided in the first supporting frame, a through hole is provided on the slider, and the at least one roller extends into the through hole.

As a further improvement of the present invention, the left dielectric wetting splint includes a left glass substrate, a left splint electrode, and a left hydrophobic layer arranged in sequence from outside to inside, the left splint electrode is connected to the movable friction material, the right dielectric wetting splint includes a right glass substrate, a right splint electrode group, a dielectric layer, and a right hydrophobic layer arranged in sequence from outside to inside, the right splint electrode group includes at least two right splint electrodes arranged at intervals in an up and down direction, and the at least two right splint electrodes are respectively connected to the at least two fixed friction electrodes.

As a further improvement of the present invention, the left glass substrate and the slider are connected by a first adhesive tape, and the right glass substrate and the second supporting frame are connected by a second adhesive tape.

As a further improvement of the present invention, two pin shafts are connected between an upper end of the second supporting frame and the first supporting frame.

A method of nondestructive transfer of liquid drops, applicable the above device and including the steps of:

(1) moving the device above a liquid drop, and making the liquid drop contact the left dielectric wetting splint and the right dielectric wetting splint;

(2) making the movable friction material repeatedly contact the fixed friction material corresponding to the right splint lower electrode to generate an electric field on the right splint lower electrode to drive the liquid drop to move upward;

(3) moving the movable friction material onto the fixed friction material corresponding to the right splint upper electrode to generate an electric field on the right splint upper electrode to drive the liquid drop to move to a corresponding position of the right splint upper electrode;

(4) moving the movable friction material onto the fixed friction material corresponding to the right splint lower electrode, and moving the liquid drop to a corresponding position of the right splint lower electrode; and (5) moving the left dielectric wetting splint away from the right dielectric wetting splint, and at the same time making the movable friction material contact the fixed friction material corresponding to the right splint lower electrode, such that the liquid drop leaves the device to complete the release.

A method of micro-reaction of liquid drops, applicable to the above device and including the steps of:

(1) moving the device above a first liquid drop, and making the first liquid drop contact the left dielectric wetting splint and the right dielectric wetting splint;

(2) making the movable friction material repeatedly contact the fixed friction material corresponding to the right splint lower electrode to generate an electric field on the right splint lower electrode to drive the first liquid drop to move upward;

(3) moving the movable friction material onto the fixed friction material corresponding to the right splint upper electrode to generate an electric field on the right splint upper electrode to drive the first liquid drop to move to a corresponding position of the right splint upper electrode;

(4) moving the device above a second liquid drop, and making the second liquid drop contact the left dielectric wetting splint and the right dielectric wetting splint; and (5) making the movable friction material contact the fixed friction material corresponding to the right splint lower electrode to generate an electric field on the right splint lower electrode to drive the first and second liquid drops to move to a corresponding position of the right splint lower electrode simultaneously and fuse at the corresponding position to complete micro-reaction.

The beneficial effects of the present invention are as follows.

(1) A triboelectric nanogenerator is adopted to generate electricity to drive liquid drops, replacing the traditional motor, simplifying the structure of the device and making the device more portable.

(2) Through the use of a crank connecting rod mechanism, the left dielectric wetting splint realizes horizontal movement, in order to adjust the distance between the left dielectric wetting splint and the right dielectric wetting splint and adapt to liquid drops of different volumes.

(3) By providing two rollers on the same horizontal line, the accuracy of the horizontal movement of the left splint is ensured.

(4) By providing a bolt and a spring, when the bolt is screwed or unscrewed, the left dielectric wetting splint moves horizontally to the right or horizontally to the left, which is convenient and quick to adjust.

(5) Two pin shafts are connected between the first supporting frame and the second supporting frame to ensure that the left dielectric wetting splint is parallel to the right dielectric wetting splint.

(6) A left splint electrode, a right splint lower electrode and a right splint upper electrode are provided. An electric field is generated on the right splint lower electrode or the right splint upper electrode through electricity generation by friction to control the movement of the liquid drop, which can realize the driving and fusion and the like of the liquid drop.

BRIEF DESCRIPTION OF THE DRAWINGS

For clearer descriptions of the technical solutions in the embodiments of the present invention or the prior art, the following briefly introduces the accompanying drawings required for describing the embodiments or the prior art. Apparently, the accompanying drawings in the following description show merely some embodiments of the present disclosure, and persons of ordinary skill in the art may still derive other drawings from these accompanying drawings without creative efforts.

In the figures: 10, movable friction material, 12, supporting mechanism, 14, left dielectric wetting splint, 16, right dielectric wetting splint, 18, first supporting frame, 20, second supporting frame, 22, crank, 24, slider, 26, bolt, 28, spring, 29, supporting block, 30, supporting shaft, 32, waist-shaped hole, 34, supporting rod, 36, roller, 38, through hole, 40, left glass substrate, 42, left splint electrode, 44, left hydrophobic layer, 46, right glass substrate, 48, dielectric layer, 50, right hydrophobic layer, 52, first fixed friction material, 54, second fixed friction material, 56, right splint lower electrode, 58, right splint upper electrode, 60, pin shaft, 62, liquid drop.

DETAILED DESCRIPTION

In order to enable those skilled in the art to better understand the technical solutions of the present invention, the technical solutions in the embodiments of the present invention will be described clearly and completely in conjunction with the accompanying drawings in the embodiments of the present invention. Obviously, the described embodiments are merely some embodiments of the present invention, not all the embodiments. Based on the embodiments of the present invention, all other embodiments obtained by those skilled in the art without creative work shall fall within the scope of protection of the present invention.

Figure 1:
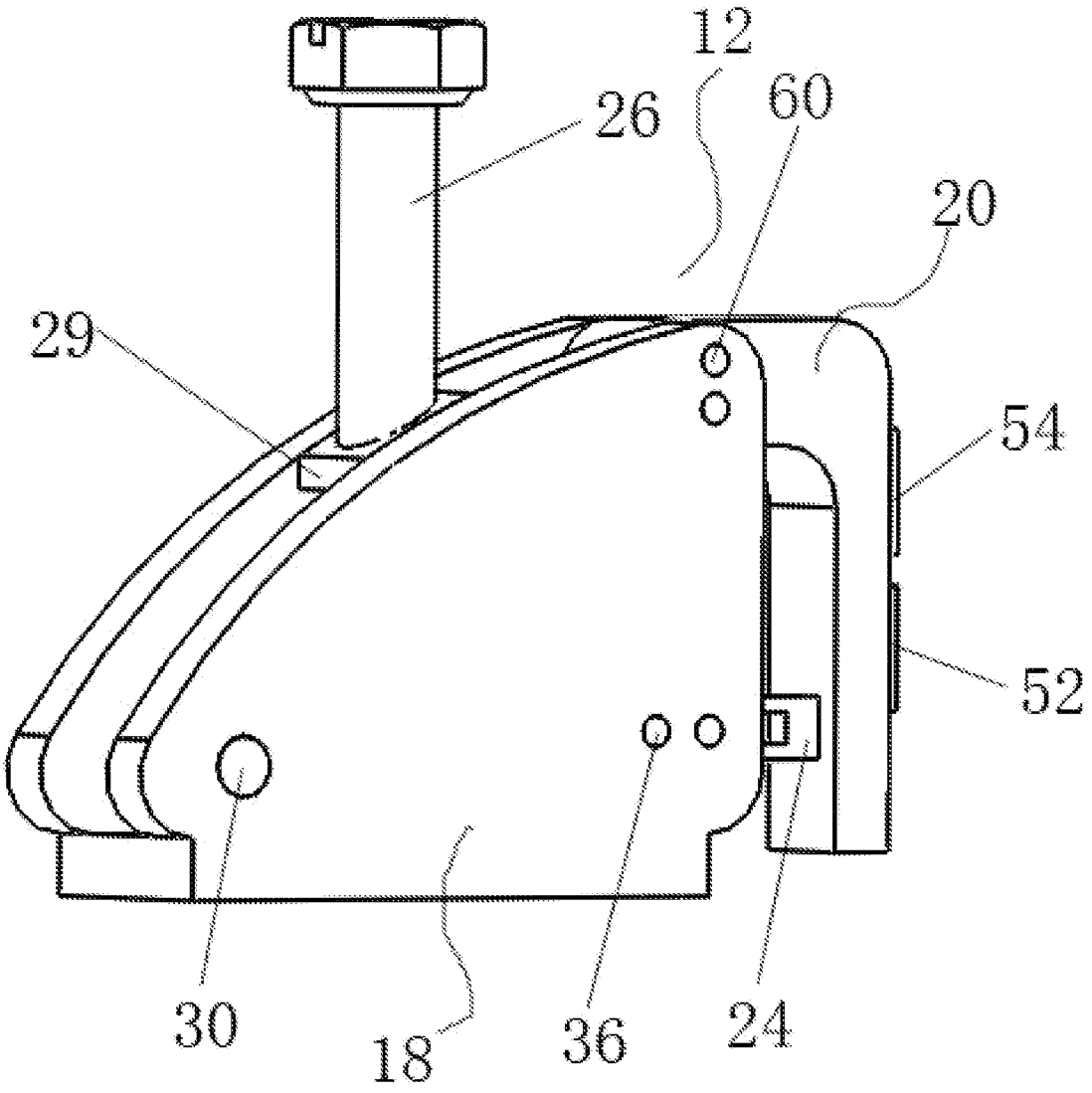
FIG. 1 is a schematic diagram of an overall structure of a preferred embodiment of the present invention.
Figure 2:
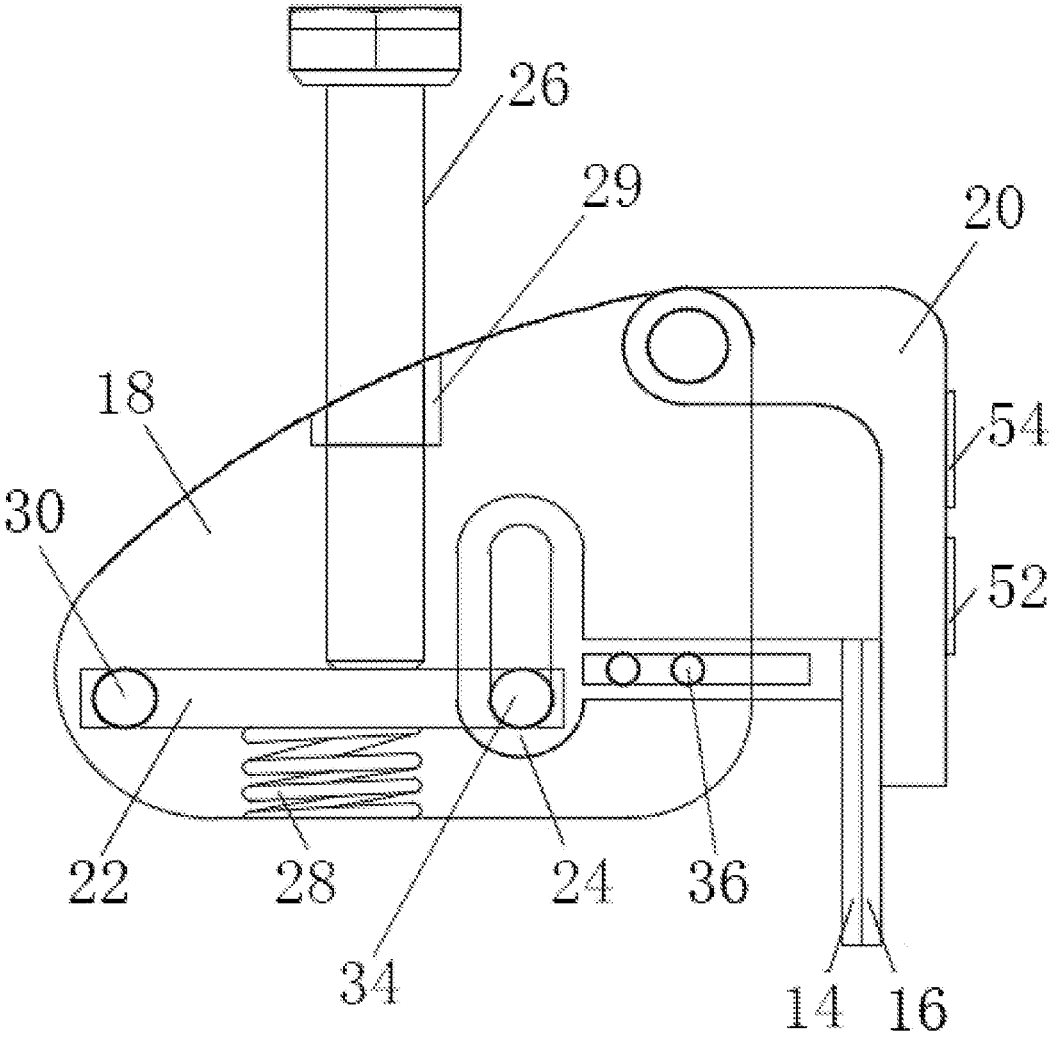
FIG. 2 is a schematic diagram of an internal structure of a preferred embodiment of the present invention.

As shown in FIGS. 1 and 2, a device of nondestructive transfer of liquid drops includes a power generation part and a clamping part. The power generation part includes a movable friction material 10 and at least two fixed friction materials. The clamping part includes a supporting mechanism 12 and a left dielectric wetting splint 14 and a right dielectric wetting splint 16 mounted on the supporting mechanism 12. The movable friction material 10 is connected to the left dielectric wetting splint 14. The at least two fixed friction materials are connected to the right dielectric wetting splint 16.

In a preferred embodiment of the present invention, the supporting mechanism 12 includes a first supporting frame 18 and a second supporting frame 20 connected to the first supporting frame 18. The left dielectric wetting splint 14 is mounted on the first supporting frame 18. The right dielectric wetting splint 16 and the at least two fixed friction materials are installed on the second supporting frame 20.

Figure 3:
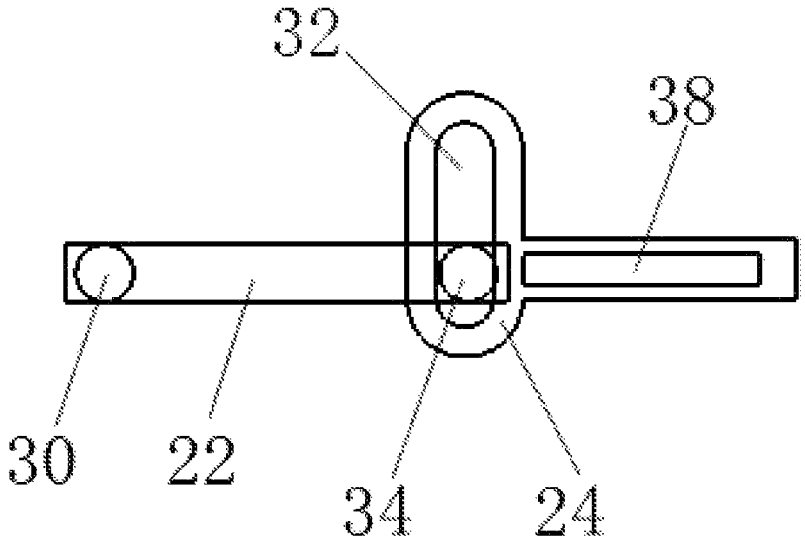
FIG. 3 is a front view of a crank connecting rod mechanism according to a preferred embodiment of the present invention.
Figure 4:
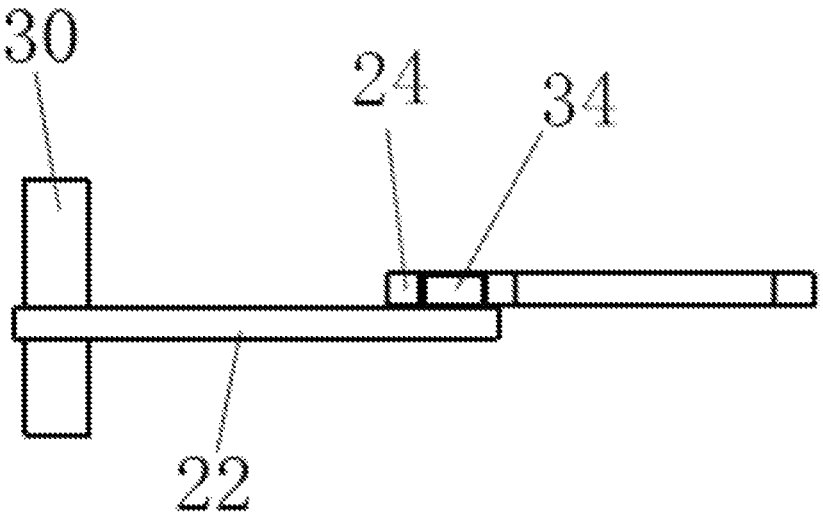
FIG. 4 is a top view of the crank connecting rod mechanism according to a preferred embodiment of the present invention.

As shown in FIGS. 3 and 4, a crank connecting rod mechanism is also provided.

The crank connecting rod mechanism includes a crank 22 and a slider 24 movably connected to one end of the crank 22. The other end of the crank 22 is hinged with the first supporting frame 18. The slider 24 is connected to the left dielectric wetting splint 14. When the crank 22 rotates, the left dielectric wetting splint 14 is driven by the slider 24 to move away from or toward the right dielectric wetting splint 16, thereby adjusting the distance between the left dielectric wetting splint 14 and the right dielectric wetting splint 16 to adapt to liquid drops of different volumes.

In a preferred embodiment of the present invention, an upper part of the first supporting frame 18 is connected to a bolt 26. A lower part of the first supporting frame 18 is provided with a spring 28. The bolt 26 abuts against an upper end of the crank 22. The spring 28 abuts against a lower end of the crank 22. When the bolt 26 is screwed, the crank 22 moves clockwise under the pressure of the bolt 26. At the same time, the spring 28 is compressed, such that the left dielectric wetting splint 14 moves to the right, as shown in FIG. 2. In this case, the bolt 26 is in a screwed state. When the bolt 26 is unscrewed, the crank 22 moves counterclockwise under the action of the spring 28, such that the left dielectric wetting splint 14 moves to the left. In a further preferred embodiment of the present invention, a supporting block 29 is provided in the first supporting frame 18. The bolt 26 is threadedly connected to the supporting block 29 and extends out of the supporting block 29.

In a preferred embodiment of the present invention, a supporting shaft 30 is provided in the first supporting frame 18. The crank 22 is sleeved on the supporting shaft 30 and can rotate around the supporting shaft 30.

In a preferred embodiment of the present invention, the slider 24 is provided with a waist-shaped hole 32 which extends in an up and down direction. One end of the crank 22 is provided with a supporting rod 34 which extends into the waist-shaped hole 32. The supporting rod 34 moves in the waist-shaped hole 32 to drive the slider 24 to move in a left and right direction.

In a preferred embodiment of the present invention, at least one roller 36 is provided in the first supporting frame 18. A through hole 38 is provided on the slider 24 which extends in a horizontal direction. The at least one roller 36 extends into the through hole 38. When the slider 24 moves left and right, the roller 36 is used for guidance to avoid the skew of the slider 24 and ensure the accuracy of the left and right horizontal movement of the left dielectric wetting splint 14. In a further preferred embodiment of the present invention, the number of the rollers 36 is two, and the two rollers 36 are on the same horizontal line.

Figure 5:
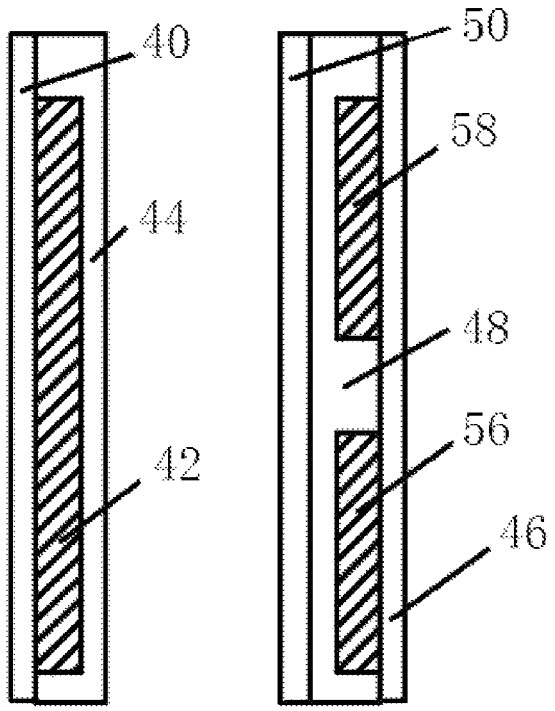
FIG. 5 is a schematic diagram of a structure in which a left dielectric wetting splint and a right dielectric wetting splint are opposite to each other according to a preferred embodiment of the present invention.

As shown in FIG. 5, in a preferred embodiment of the present invention, the left dielectric wetting splint 14 includes a left glass substrate 40, a left splint electrode 42, and a left hydrophobic layer 44 arranged in sequence from outside to inside. The left splint electrode 42 is connected to the movable friction material 10. The right dielectric wetting splint 16 includes a right glass substrate 46, a right splint electrode group, a dielectric layer 48, and a right hydrophobic layer 50 arranged in sequence from outside to inside. The right splint electrode group includes at least two right splint electrodes arranged at intervals in the up and down direction which are respectively connected to the at least two fixed friction materials. In this embodiment, the number of the fixed friction materials is two, and the two fixed friction materials are a first fixed friction material 52 and a second fixed friction material 54, respectively. The number of the right splint electrodes is two, and the two right splint electrodes are a right splint lower electrode 56 and a right splint upper electrode 58, respectively. The first fixed friction material 52 is connected to the right splint lower electrode 56. The second fixed friction material 54 is connected to the right splint upper electrode 58. Because the movable friction material 10 is connected to the left splint electrode 42, the electrical properties on the left splint electrode 42 and the right splint lower electrode 56 or the right splint upper electrode 58 are always different.

In a preferred embodiment of the present invention, the movable friction material 10, the first fixed friction material 52, and the second fixed friction material 54 are all subjected to electrostatic spinning treatment to increase the friction contact area and improve the power generation efficiency. In a preferred embodiment, the movable friction material 10 is Kapton, and the first fixed friction material 52 and the second fixed friction material 54 are aluminum sheets.

In a further preferred embodiment of the present invention, both the left hydrophobic layer 44 and the right hydrophobic layer 50 are made of Teflon materials, but they are not limited to Teflon materials, and may also be made of nanoparticle coatings. In a further preferred embodiment of the present invention, the dielectric layer 48 is made of PDMS material, but it is not limited to PDMS material, and may also be made of PMMA or SU-8.

In order to improve the stability of the left dielectric wetting splint 14 mounted on the first supporting frame 18 and the stability of the right dielectric wetting splint 16 mounted on the second supporting frame 20, in a preferred embodiment of the present invention, the left glass substrate 40 and the slider 24 are connected by a first adhesive tape (not shown), and the right glass substrate 46 and the second supporting frame 20 are connected by a second adhesive tape (not shown).

In a preferred embodiment of the present invention, the second supporting frame 20 is in an inverted L shape, which facilitates the installation of the right dielectric wetting splint 16 and at the same time facilitates the connection with the first supporting frame 18. In order to keep the left dielectric wetting splint 14 and the right dielectric wetting splint 16 parallel, in a preferred embodiment of the present invention, two pin shafts 60 are connected between an upper end of the second supporting frame 20 and the first supporting frame 18.

Under the action of an electric field force, a liquid drop will produce a dielectric wetting effect, which may be expressed by a Young-Lippman equation (1):

$$\cos\theta(V) = \cos\theta_0 + \frac{\varepsilon_0\varepsilon_d}{2\gamma_{ld}t}V^2 \tag{1}$$

where $\theta_0$ is a contact angle between the liquid drop and a solid surface when the voltage is 0, $\theta(V)$ represents the contact angle between the liquid drop and the solid surface when the voltage is V, $\varepsilon_0$ is a permittivity in vacuum, $\varepsilon_d$ is a relative permittivity, $\gamma ld$ is a gas-liquid surface tension, t is the thickness of the dielectric layer, and V is the applied voltage.

Figure 6:
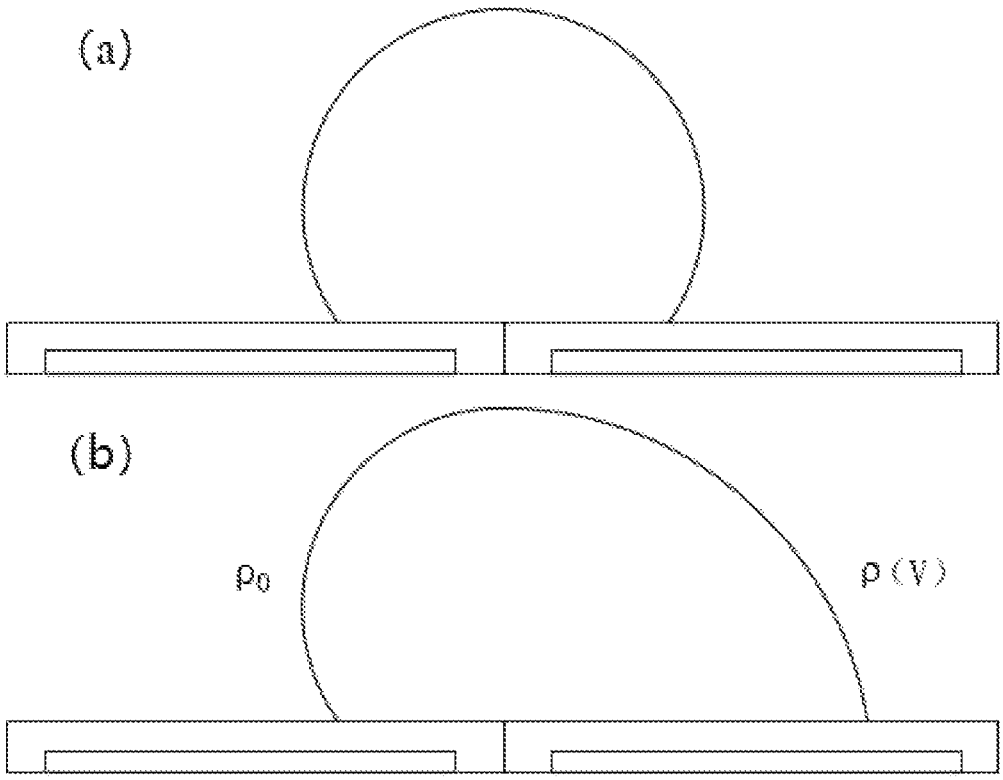
FIG. 6 is a drive principle diagram of dielectric wetting according to a preferred embodiment of the present invention.

FIG. 6 is a drive principle diagram of dielectric wetting. When an electrode under a liquid drop is energized, a corresponding contact angle changes accordingly, and the shape of the liquid drop is also deformed. An initial state of the liquid drop is shown in FIG. 6(*a*). When a right electrode is energized and a left electrode is not energized, the state of the liquid drop is shown in FIG. 6(*b*). A left contact angle of the liquid drop is still $\theta_0$, a radius of curvature of the liquid drop profile is $\rho_0$, a right contact angle is $\theta(V)$, and the radius of curvature of the liquid drop profile is $\rho(V)$. According to a relationship (2) between the pressure difference and the radius of curvature, a Laplace pressure difference inside the liquid drop may be calculated, that is, a force that drives the liquid drop.

$$\Delta P = \gamma_{ld}\left(\frac{1}{\rho_0} + \frac{1}{\rho(V)}\right) \tag{2}$$

A method of nondestructive transfer of liquid drops of the present invention is introduced hereinafter. The method is applicable to the above device and includes the following steps.

(1) The device is moved above a liquid drop 62, and the liquid drop 62 contacts the left dielectric wetting splint 14 and the right dielectric wetting splint 16.

(2) The movable friction material 10 repeatedly contacts the fixed friction material corresponding to the right splint lower electrode to generate an electric field on the right splint lower electrode to drive the liquid drop 62 to move upward.

(3) The movable friction material 10 is moved onto the fixed friction material corresponding to the right splint upper electrode to generate an electric field on the right splint upper electrode to drive the liquid drop 62 to move to a corresponding position of the right splint upper electrode.

(4) The movable friction material 10 is moved onto the fixed friction material corresponding to the right splint lower electrode, and the liquid drop 62 is moved to a corresponding position of the right splint lower electrode.

(5) The left dielectric wetting splint 14 is moved away from the right dielectric wetting splint 16, and at the same time the movable friction material 10 contacts the fixed friction material corresponding to the right splint lower electrode, and the liquid drop 62 leaves the device to complete the release.

In order to further illustrate the method of nondestructive transfer of liquid drops of the present invention, a preferred embodiment includes the following steps.

(1) The device is moved above the liquid drop 62. The bolt is screwed or unscrewed according to the volume of the liquid drop 62 to adjust the distance between the left dielectric wetting splint 14 and the right dielectric wetting splint 16. The liquid drop 62 contacts the left dielectric wetting splint 14 and the right dielectric wetting splint 16. Meanwhile, the liquid drop 62 is located at the corresponding position of the right splint lower electrode 56, as shown in FIG. 7(*a*).

(2) The movable friction material 10 repeatedly contacts the first fixed friction material 52 which is negatively charged. Since the charging ability of the first fixed friction material 52 is lower than that of the movable friction material 10, in order to maintain electrical neutrality, the negative charge on the right splint lower electrode 56 is transferred to the first fixed friction material 52, such that the right splint lower electrode 56 is positively charged, and a positive electric field is generated on the right splint lower electrode 56, thereby producing a dielectric wetting effect and driving the liquid drop 62 to move up, as shown in FIG. 7(*b*).

(3) The movable friction material 10 is moved onto the second fixed friction material 54 which is negatively charged. Since the charging ability of the second fixed friction material 54 is lower than that of the movable friction material 10, in order to maintain electrical neutrality, the negative charge on the right splint upper electrode 58 is transferred to the second fixed friction material 54, such that the right splint upper electrode 58 is positively charged, with the right splint lower electrode 56 being not charged, and a positive electric field is generated on the right splint upper electrode 58, thereby producing a dielectric wetting effect and driving the liquid drop 62 to move to the corresponding position of the right splint upper electrode 58, as shown in FIG. 7(*c*).

Figure 7:
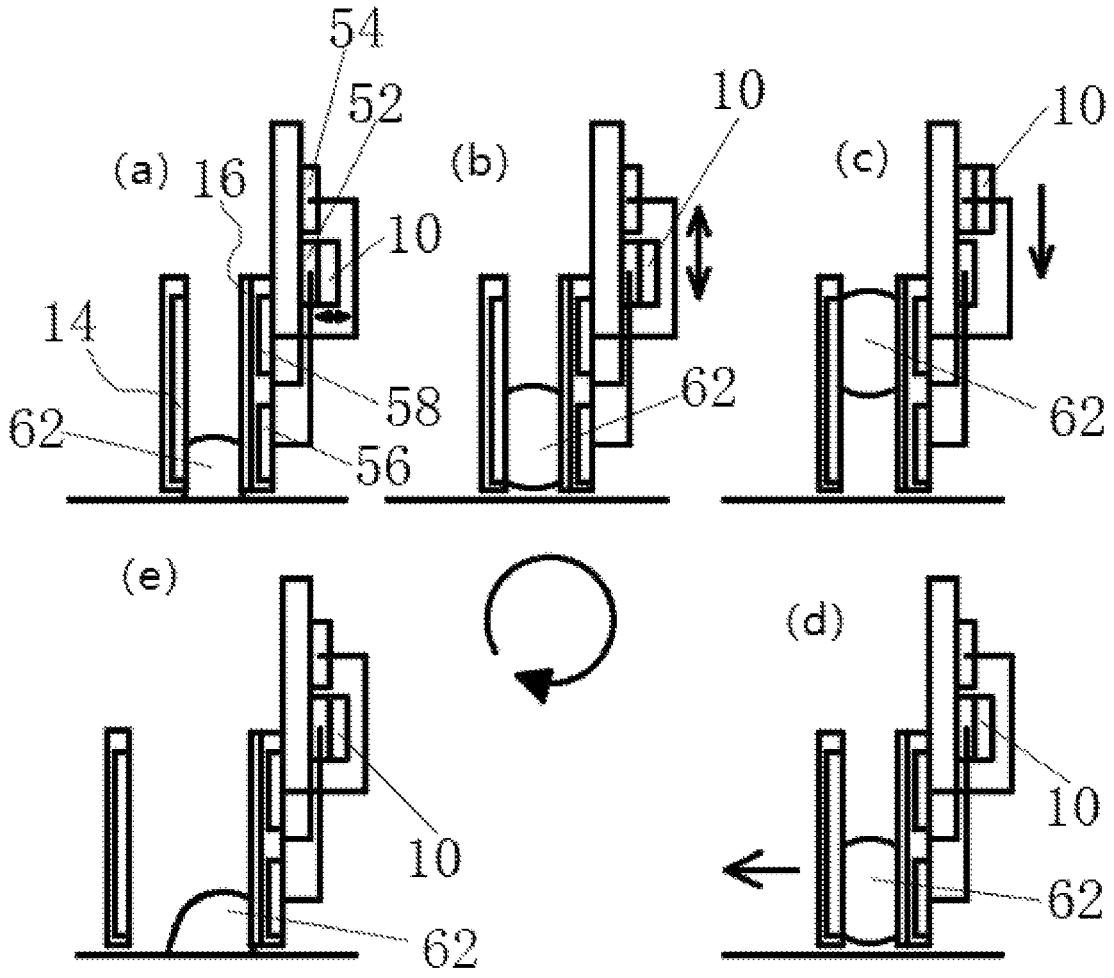
FIG. 7 is an operation principle diagram of a preferred embodiment of the present invention.

(4) The movable friction material 10 is moved onto the first fixed friction material 52, and the liquid drop 62 is moved to the corresponding position of the right splint lower electrode 56, as shown in FIG. 7(*d*).

(5) The bolt is unscrewed to move the left dielectric wetting splint 14 to the left, and at the same time the movable friction material 10 contacts the first fixed friction material 52 to neutralize the charge, and the liquid drop 62 leaves the device on the hydrophobic surface under the influence of gravity to complete the release, as shown in FIG. 7(*e*).

A method of micro-reaction of liquid drops of the present invention is introduced hereinafter. The method is applicable to the above device and includes the following steps.

(1) The device is moved above a first liquid drop, and the first liquid drop contacts the left dielectric wetting splint 14 and the right dielectric wetting splint 16.

(2) The movable friction material 10 repeatedly contacts the fixed friction material corresponding to the right splint lower electrode to generate an electric field on the right splint lower electrode to drive the first liquid drop to move upward.

(3) The movable friction material 10 is moved onto the fixed friction material corresponding to the right splint upper electrode to generate an electric field on the right splint upper electrode to drive the first liquid drop to move to a corresponding position of the right splint upper electrode.

(4) The device is moved above a second liquid drop, and the second liquid drop contacts the left dielectric wetting splint 14 and the right dielectric wetting splint 16.

(5) The movable friction material 10 contacts the fixed friction material corresponding to the right splint lower electrode to generate an electric field on the right splint lower electrode to drive the first and second liquid drops to move to a corresponding position of the right splint lower electrode simultaneously and fuse at the corresponding position to complete the micro-reaction.

In order to further illustrate the method of micro-reaction of liquid drops of the present invention, a preferred embodiment, as shown in FIG. 7, includes the following steps.

(1) The device is moved above the first liquid drop. The bolt is screwed or unscrewed according to the volume of the first liquid drop to adjust the distance between the left dielectric wetting splint 14 and the right dielectric wetting splint 16, such that the first liquid drop contacts the left dielectric wetting splint 14 and the right dielectric wetting splint 16, and at the same time, the first liquid drop is located at the corresponding position of the right splint lower electrode 56.

(2) The movable friction material 10 repeatedly contacts the first fixed friction material 52 which is negatively charged. Since the charging ability of the first fixed friction material 52 is lower than that of the movable friction material 10, in order to maintain electrical neutrality, the negative charge on the right splint lower electrode 56 is transferred to the first fixed friction material 52, such that the right splint lower electrode 56 is positively charged, and a positive electric field is generated on the right splint lower electrode 56, thereby producing a dielectric wetting effect and driving the first liquid drop to move upward.

(3) The movable friction material 10 is moved onto the second fixed friction material 54 which is negatively charged. Since the charging ability of the second fixed friction material 54 is lower than that of the movable friction material 10, in order to maintain electrical neutrality, the negative charge on the right splint upper electrode 58 is transferred to the second fixed friction material 54, such that the right splint upper electrode 58 is positively charged, with the right splint lower electrode 56 being not charged, and a positive electric field is generated on the right splint upper electrode 58, thereby producing a dielectric wetting effect and driving the first liquid drop to move to the corresponding position of the right splint upper electrode 58.

(4) The device is moved above the second liquid drop, and the second liquid drop contacts the left dielectric wetting splint 14 and the right dielectric wetting splint 16.

(5) The movable friction material 10 contacts the first fixed friction material 52 to generate an electric field on the right splint lower electrode 56 to drive the first and second liquid drops to move to the corresponding position of the right splint lower electrode 56 simultaneously and fuse at the corresponding position to complete the micro-reaction.

For those skilled in the art, it is obvious that the present invention is not limited to the details of the above exemplary embodiments, and the present invention can be implemented in other specific forms without departing from the spirit or basic characteristics of the present invention. Therefore, from any point of view, the embodiments should be regarded as exemplary and non-limiting. The scope of the present invention is defined by the appended claims rather than the above description, and therefore all changes falling into the meaning and scope of the equivalent elements of the claims are included in the present invention. Any reference numerals in the claims should not be regarded as limiting the claims in question.

In addition, it should be understood that although the description is illustrated with implementations, not each implementation only includes an independent technical solution. This narration of the description is only for clarity, and those skilled in the art should regard the description as a whole. The technical solutions in the various embodiments can also be appropriately combined to form other implementations that can be understood by those skilled in the art.

What is claimed is:

1. A device of nondestructive transfer of a liquid drop, comprising:

a power generation part, a clamping part, and a crank connecting rod mechanism, wherein:

the power generation part comprises a movable friction material and at least two fixed friction materials, the clamping part comprises a supporting mechanism and a left dielectric wetting splint and a right dielectric wetting splint installed on the supporting mechanism, the movable friction material is connected to the left dielectric wetting splint, and the at least two fixed friction materials are connected to the right dielectric wetting splint;

wherein:

the supporting mechanism comprises a first supporting frame and a second supporting frame connected to the first supporting frame, the left dielectric wetting splint is installed on the first supporting frame, and the right dielectric wetting splint and the at least two fixed friction materials are all installed on the second supporting frame; and wherein:

the crank connecting rod mechanism comprises a crank and a slider movably connected to one end of the crank, an other end of the crank is hinged with the first supporting frame, and the slider is connected to the left dielectric wetting splint.

2. The device of nondestructive transfer of the liquid drop according to claim 1, further comprising a bolt and a spring, wherein:

an upper part of the first supporting frame is connected to the bolt, a lower part of the first supporting frame is provided with the spring, the bolt abuts against an upper end of the crank, and the spring abuts against a lower end of the crank.

3. The device of nondestructive transfer of the liquid drop according to claim 1, wherein:

at least one roller is provided in the first supporting frame, a through hole is provided on the slider, and the at least one roller extends into the through hole.

4. The device of nondestructive transfer of the liquid drop according to claim 1, wherein the left dielectric wetting splint comprises:

a left glass substrate, a left splint electrode, and a left hydrophobic layer, wherein:

the left splint electrode is connected to the movable friction material, the right dielectric wetting splint comprises a right glass substrate, a right splint electrode group, a dielectric layer, and a right hydrophobic layer, and wherein:

the right splint electrode group comprises:

at least two right splint electrodes arranged at intervals in an up and down direction, and the at least two right splint electrodes are a right splint upper electrode and a right splint lower electrode and respectively connected to the at least two fixed friction materials.

5. The device of nondestructive transfer of the liquid drop according to claim 1, wherein two pin shafts are connected between an upper end of the second supporting frame and the first supporting frame.

6. A method of nondestructive transfer of a liquid drop, applicable to the device according to claim 4 and comprising the following steps:

(1) moving the device above a liquid drop, and making the liquid drop contact the left dielectric wetting splint and the right dielectric wetting splint;

(2) making the movable friction material repeatedly contact one of the at least two fixed friction materials corresponding to the right splint lower electrode to generate an electric field on the right splint lower electrode to drive the liquid drop to move upward;

(3) moving the movable friction material onto another of the at least two fixed friction materials corresponding to the right splint upper electrode to generate an electric field on the right splint upper electrode to drive the liquid drop to move to a corresponding position of the right splint upper electrode;

(4) moving the movable friction material onto the one of the at least two fixed friction materials corresponding to the right splint lower electrode, and moving the liquid drop to a corresponding position of the right splint lower electrode; and (5) moving the left dielectric wetting splint away from the right dielectric wetting splint, and at the same time making the movable friction material contact the one of the at least two fixed friction materials corresponding to the right splint lower electrode, such that the liquid drop leaves the device to complete the release transfer for the liquid drop from the device.

7. A method of micro-reaction of a liquid drop, applicable to the device according to claim 4 and comprising the following steps:

(1) moving the device above a first liquid drop, and making the first liquid drop contact the left dielectric wetting splint and the right dielectric wetting splint;

(2) making the movable friction material repeatedly contact one of the at least two fixed friction materials corresponding to the right splint lower electrode to generate an electric field on the right splint lower electrode to drive the first liquid drop to move upward;

(3) moving the movable friction material onto another of the at least two fixed friction materials corresponding to the right splint upper electrode to generate an electric field on the right splint upper electrode to drive the first liquid drop to move to a corresponding position of the right splint upper electrode;

(4) moving the device above a second liquid drop, and making the second liquid drop contact the left dielectric wetting splint and the right dielectric wetting splint; and (5) making the movable friction material contact the one of the at least two fixed friction materials corresponding to the right splint lower electrode to generate an electric field on the right splint lower electrode to drive the first and second liquid drops to move to a corresponding position of the right splint lower electrode simultaneously and fuse at the corresponding position to complete micro-reaction of the first and second liquid drops.

* * * * *